US005252776A

United States Patent [19]

Mutoh

[11] Patent Number: 5,252,776

[45] Date of Patent: Oct. 12, 1993

[54] MUSICAL TONE SYNTHESIZING APPARATUS

[75] Inventor: Takaaki Mutoh, Hamamatsu, Japan

[73] Assignee: Yamaha Corporation, Hamamatsu, Japan

[21] Appl. No.: 615,807

[22] Filed: Nov. 19, 1990

[30] Foreign Application Priority Data

Nov. 22, 1989 [JP] Japan ..... 1-303681

[51] Int. Cl.[5] ..... G10H 5/02

[52] U.S. Cl. ..... 84/659; 84/661; 84/DIG. 9; 84/DIG. 10; 84/DIG. 26

[58] Field of Search ..... 84/659-661, 84/DIG. 9, DIG. 10, DIG. 26

[56] References Cited

U.S. PATENT DOCUMENTS

| | | | |
|---|---|---|---|
| 4,099,135 | 7/1978 | Laupman | 84/701 |
| 4,907,484 | 3/1990 | Suzuki et al. | 84/661 |
| 4,984,276 | 1/1991 | Smith | 381/63 |

*Primary Examiner*—William M. Shoop, Jr.
*Assistant Examiner*—Brian Sircus
*Attorney, Agent, or Firm*—Graham & James

[57] ABSTRACT

A musical tone generating apparatus comprises an excitation signal generator, a signal processing device and loop gain controller. The signal processing device is electrically connected in a closed feedback loop with the excitation signal generator, via a delay unit. The loop gain controller controls gain of said closed feedback loop according to a lapse of time.

8 Claims, 3 Drawing Sheets

MUSICAL TONE SYNTHESIZING APPARATUS

FIELD OF THE INVENTION

The present invention relates to an apparatus for synthesizing musical tones which resemble those produced by conventional (hereinafter referred to as natural) musical instruments, in particular, the decaying sounds of string type instruments.

BACKGROUND ART

Methods are known for synthesizing musical tones by means of modelling and reproducing the vibrational modes of various musical instruments. For example, to simulate the decaying sounds of a plucked string instrument, such as guitars, or of a struck string instrument, such as pianos, a closed-loop electric circuit can be used, consisting of a delay simulation circuit to represent the propagation modes of vibrating strings, and a low-pass filter circuit to represent acoustic decay of vibrating strings.

When such a circuit is excited with an input signal, representing an impact of a hammer striking a string, the excitation signal can be made to loop around the circuit to simulate the resonance vibration of the string. In such a circuit, the excitation signal undergoes decay, caused by the action of low-pass filters, to simulate the natural decay of a sound of an activated string. The decayed signal can be reproduced electrically to generate a musical tone to simulate the type of sound made by the natural instrument. Such techniques are disclosed in Japanese Patent Application Laid-Open Nos. S52-73721 and S63-40199.

In real situations, however, the natural musical tone colors generated by natural instruments display a variety of tone envelopes depending on the initial and residual touching modes, in the case of pianos and likewise for guitars, depending on such factors as the manner of plucking and the hardness of a pick.

Therefore, the present technology of simple adjustments of low-pass filters in a closed-loop circuit is inadequate for faithful reproduction of complex tone envelopes generated by natural instruments.

SUMMARY OF THE PRESENT INVENTION

The purpose of the present invention is to provide a musical tone synthesizing apparatus which enables generation of sounds whose tone envelopes are freely adjustable.

The invented musical tone synthesizing apparatus produces a tone according to a play of a note which initiates an external electrical input signal to an excitation signal generating device, which outputs a predetermined excitation signal to a signal processing device which is electrically connected, in a closed loop circuit, to the excitation signal generation device. The signal processing steps include controllable delays in the phase angle and controllable variations in the amplitude of the feedback signal. By controlling the loop gain of said feedback signal in accordance with the time duration of said play, and by superimposing the real-time play mode of said external input signal, a rich musical tone having a controllable complex tone envelope is generated from the musical tone generator to simulate the tone color of conventional musical instruments.

DETAILED DESCRIPTION OF THE PREFERRED EMBODIMENTS

A first embodiment of this invention is explained in the following with reference to Figures presented above.

Figure 1:
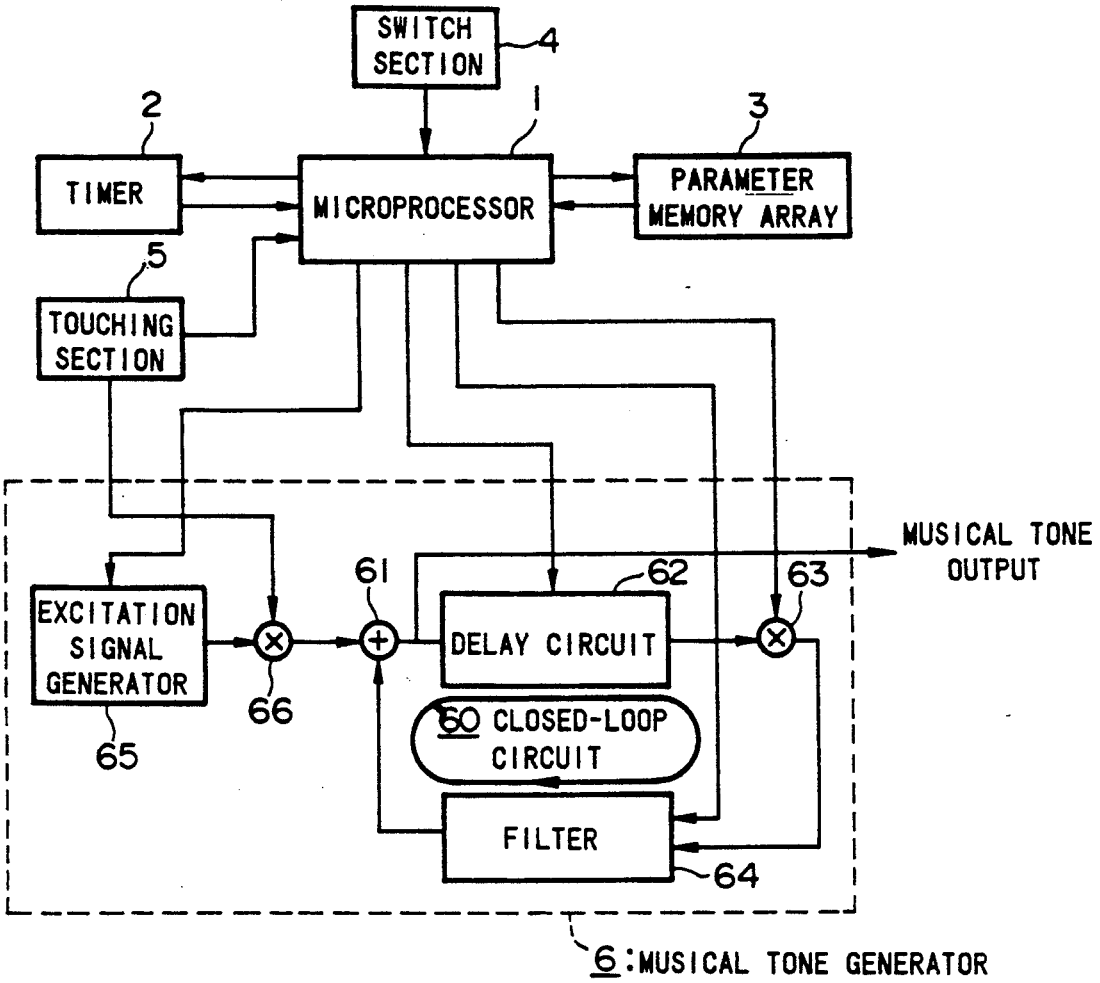
FIG. 1 is a schematic block diagram of a first embodiment of this invention, showing the various components of the tone synthesizing apparatus.

FIG. 1 is a schematic block diagram showing the various components of the tone synthesizing apparatus. As shown in this figure, the apparatus comprises a microprocessor 1 which controls various component circuits of the apparatus, a timer 2, parameter memory array 3, manually operable switch section 4 (hereinafter referred to as switch section 4), playing mode input section 5 (hereinafter referred to as touching section 5) and a musical tone generator 6.

Microprocessor 1 controls the timing of timer 2 which supplies interrupt signals to the microprocessor at regular time intervals. The switch section 4 is connected to a playing mode switch of a keyboard (not shown) which transmits information concerning the playing modes to the microprocessor 1. When a key/chord is played, the touching section 5 analyzes the manner of initial and residual touching information, and constructs playing mode data, which are supplied to both the microprocessor 1 and the musical tone generator 6.

Parameter memory array 3 contains all the necessary data regarding the musical tone generation, such as delay coefficients, decay data table, coefficients for filtering computation and other parameters essential for musical tone generation. The data from the parameter memory array 3 such as key-on event transmitted through the switch section 4 and other parameters corresponding to playing mode data, are supplied to the microprocessor 1, and to the musical tone generator 6.

The musical tone generator 6 comprises an adder 61, a delay circuit 62, a closed-loop circuit 60 consisting of a multiplier 63 and digital filters 64, an excitation signal generator 65 and an adder 66. The excitation signal generator 65 contains wave form memory section which stores many excitation signals of a wide variety of frequencies, including impulse wave forms, for example. When the microprocessor 1 commands a tone generation, the excitation signal generator 65 begins receiving various excitation wave forms stored in wave form memory section. These memory wave forms are compared against the inputted playing mode data, representing the style of key/chord pressing and touching, from the touching section 5 of the keyboard, and appropriate data are inputted into the multiplier 66. The results are then transmitted to one end of the input terminals of the adder 61.

The output signals from the adder 61 are fed back to the other end of the terminal of the adder after going through the delay circuit 62, the multiplier 63 and the filters 64. Therefore, once the excitation wave forms, generated by the excitation signal generator 65 and transmitted through the multiplier 66, are introduced into the closed-loop circuit 60, they begin circulating (looping) around within this circuit.

The delay circuit 62 comprises, for example, shift registers to create delaying effects of the input signals, and selectors to output appropriate signals selected from the delayed signals. The delay time is decided by the delay coefficients calculated by the microprocessor 1. The delay time requirement for the circuit 62 is set s that the time required for the signal to make a complete loop around the circuit 60 is equal to the value of the inverse of the first resonance frequency of the tone to be generated.

Figure 7:
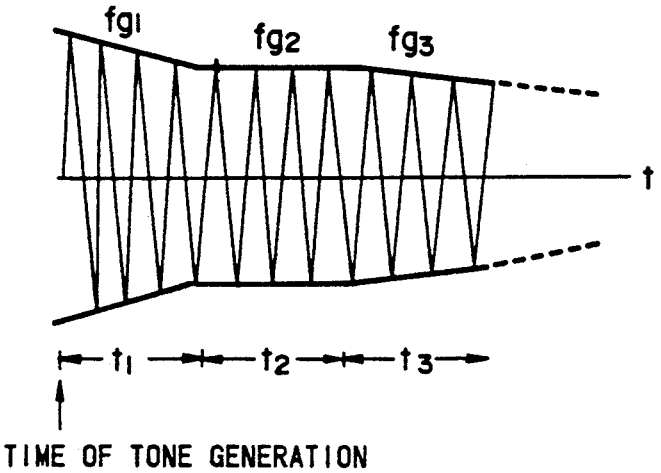
FIG. 7 illustrates an example of wave forms and of a tone envelope.

The decay coefficients for the multiplier 63 are determined and progressively altered, by the microprocessor 1, according to the elapsed time, measured from the instant of the tone generation. As a result, a tone envelop such as the one shown in FIG. 7 is achieved, which shows the time-dependent variations of the amplitude of vibration as the musical tone signal is made to loop around the closed-loop circuit 60.

Figure 2:
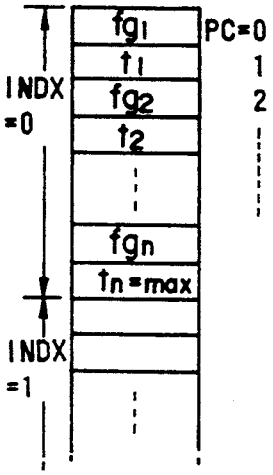
FIG. 2 is an example of a data table for tone color generation.

The parameter memory array 3 includes decay data tables for determining the decay coefficients; for example, a portion of such a table is illustrated in FIG. 2. Each table consists of alternating sets of a decay coefficient, fg, accompanied by its duration, t, as $fg_1$, $t_1$, $fg_2$, $t_2$, $fg_3$, $t_3$, . . . $fg_n$, $t_n$ and so on. The last coefficient in the table, $fg_n$, is for use after the key-release.

The parameter memory array 3 contains a variety of decay data reference tables to correspond with a variety of requirements dealing with the tone pitch, initial touch and residual touch and so on, representing a variety of playing conditions. Microprocessor 1 computes an index, INDX, for use in data-seach in the decay table array, according to parametric requirements, determined by both the key code and key-on event triggered by the switch section 4, and by the real-time playing data collected by the touching section 5. The contents of the decay data table, INDX, is read by the microprocessor 1 and delivered in successive order to the multiplier 63, to carry out the task of switching the decay coefficients.

Filter 64 simulates acoustic loss of string sounds, and comprises low-pass filters, for example finite impulse response digital filter (FIR), and the coefficients for computation of acoustic loss are performed by the microprocessor 1. The reference coefficients for filters are also stored in the parameter memory array 3, corresponding to a variety of parametric requirements of the various key code. The appropriate parametric data for the key code (being played) are read off the memory array 3 and are applied to the filter 64, as required.

The operation of the musical tone synthesizer is explained below with reference t flow charts shown in FIGS. 3 to 6

Figure 3:
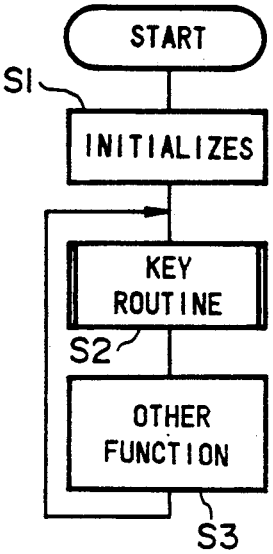
FIGS. 3 to 6 show flow charts for the various component circuits.

When the power switch for the apparatus is turned on, the microprocessor 1 proceeds to step S1 of the main routine program shown in FIG. 3. The microprocessor 1 initializes all the registers, flags and other memory cells used for the control function contained within its internal memory. Thereafter, it repeats other processes for other function keys, such as the key routine (step S2) and for other ancillary function keys such as manually operable tone switch, volume control switch, and others in step 3 (S3).

Figure 4:
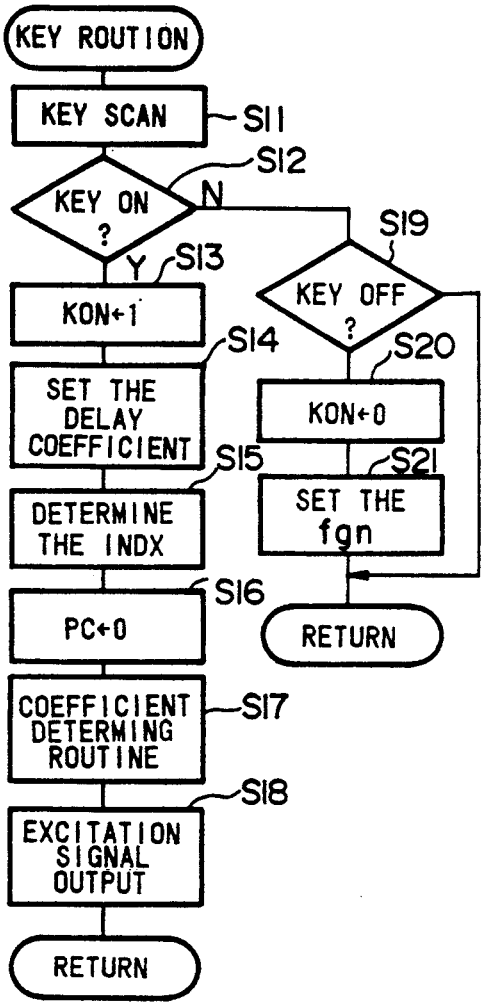

In step S2, the key routine is activated, and the tone generation program routine (hereinafter referred to as the routine) proceeds to step S11 as shown in FIG. 4. In this step, various key action events on the keyboard, transmitted through the switch section 4, are recorded in the shift registers. Proceeding onto step S12, the microprocessor 1 checks whether the key event is the key-on event or not. If the keyboard is not turned on, the routine routes to "NO" and proceeds to step S19 to check whether the key-off event is operated by the switch section 4. If the key is not turned-off, both steps S12 and S19 route to "NO", and the routine returns to step S3 of the main routine, and repeats the above process of scanning for the status of other function keys.

When a key (not shown in FIG. 4) is operated to turn on the apparatus, the steps S11 to S12 in the key routine shown in FIG. 4 are activated. The control takes the "YES" route to step S13, where the key-on flag KON is set to "1" to indicate that the key is being depressed. At this point in step 14, a reference delay coefficient corresponding to the sound of the key code of the key (being depressed) is read out of the delay coefficient memory array 3, and inputted into the delay circuit 62. Proceeding onto step S15, an INDX table is set up to record the playing data, based on the reference key code and touch data of the touching section 5, to determine the decay coefficient for a musical key being played. In step S16, the parameter count PC in the decay reference data table are set to P=0, and in step S17, the microprocessor 1 activates the coefficient-determining routine shown in FIG. 5.

Figure 5:
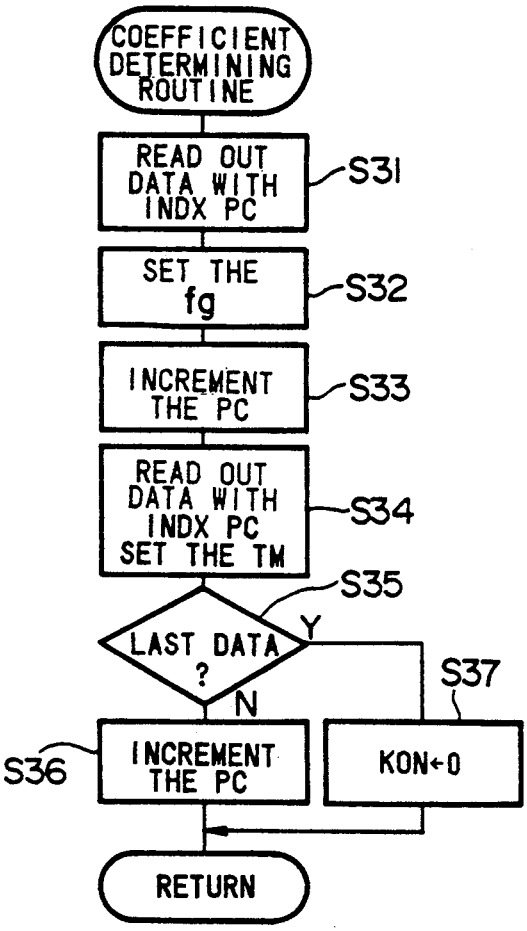

The coefficient-determining routine of the routine begins at step S31 shown in FIG. 5. The microprocessor reads out a parameter value to correspond with the appropriate parameter count PC from the reference decay data memory array 3, in this case, PC=0 in FIG. 4. The result is a storage, in the microprocessor 1, of the first decay coefficient, $fg_1$, of the initial tone generation stage. In the next step S32, the chosen parameter, $fg_1$, is entered into the multiplier 63. In the next step S33, the PC is incremented by one and the control proceeds to step S34, where the microprocessor 1 reads out a time value, $t_1$, corresponding to PC=1 from the decay data array. This time value is stored temporarily in a register, to serve as a time marker TM to measure the elapsed time between the TM event and the next event.

The control proceeds to step S35, which tests whether or not the data in step S34 are the last data in the decay data table. This is made possible because there is stored a last decay data in each of the reference decay memory array, distinguishable clearly from the rest of the data by the extraordinary length of elapsed time associated with it. By this means, it is possible to judge whether or not the data read in the step S34 are complete. When the test result is "NO", the microprocessor 1 goes on to step S36 to increment the PC by one to repeat the key routine as shown in FIG. 4.

When the control reaches step S18 in FIG. 4, a tone generation command is issued to the excitation signal generator 65. The resulting wave data produced by the excitation signal generator 65 are multiplied in the multiplier 66 by the respective multiplier coefficients corresponding to the touch data and are then inputted to the closed-loop circuit 60, via the adder 61. The signal loops around within the circuit 60 while the signal level is being decremented gradually according to the decay coefficients, $fg_1$, given to the multiplier 63 (refer to FIG. 7). Once the key subroutine is completed at step S18, the routine returns to step S3 of the main routine.

Figure 6:
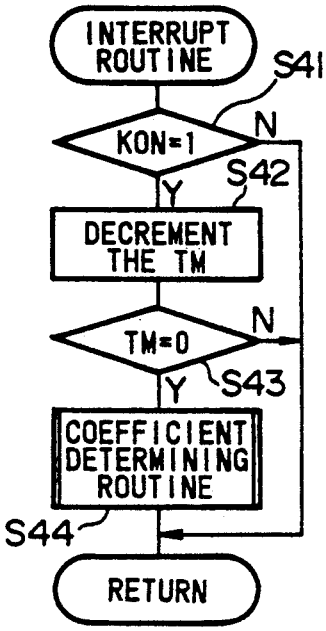

Throughout the above process, the control can interrupt any of the routine processing steps by means of the interrupt subroutine shown in FIG. 6. The interrupt subroutine is triggered by the interrupt signal from the timer 2. The microprocessor 1 upon receiving the interrupt signal proceeds to step S41, and examines whether or not the key-on flag KON is "1". In this case of "YES" the routine proceeds to step S42 to decrement the TM, and in step S43 it examines whether or not the TM=0, that is, whether sufficient time has elapsed to input another decay signal. In the case of "NO", the routine discontinues the interruption subroutine, and returns to the main routine. From this point on, every time an interrupt signal is generated, the time marker TM is decremented.

In step S42 of the above interrupt routine process, shown in FIG. 6, if the time marker becomes TM=0, then the routine routes to "YES" in step S43 and proceeds onto step S44 to carry out the coefficient generation subroutine shown in FIG. 5. The resulting new decay coefficient $fg_2$ is read out of the memory array 3 in step S31, and is applied to the multiplier 63 in step S32. Accordingly, a new time value $t_2$ is generated and stored as a new TM in step S34. The tone signal looping around in the closed circuit 60 is made to decay gradually, during the time interval $t_2$, according to the decay coefficient $fg_2$ (refer to FIG. 7). From this point on, the control repeats the processes of replacing decay coefficients, $fg_k$ (where $k=3, 4, \ldots, n-1$) read off the decay memory array and their accompanying elapsed time values $t_k$ (where $k=3, 4, \ldots, n-1$), to be applied to the computation of tone signal decay.

In step S35 of the coefficient generation subroutine, when the data read is the last decay memory data, then the routine routes to "YES", and proceeds to step S37 to turn the key-on flag KON to "0". As a result, even if the interrupt subroutine is activated at this stage, the routine stops at step S41, because the key-on flag in step S41 would route to "NO". From this point on, the musical tone decays according to the final-entry decay coefficient, $fg_n$.

When a play is ended by releasing the key, a key-off signal is send to microprocessor 1 to activate the key routine shown in FIG. 4. The routine routes to step S19 via steps S11 and S12, at which step it proceeds to step S20 through the "YES" flag to turn the key-on flag to "0". The routine proceeds onto step S21 to set the final decay coefficient, $fg_n$ in the multiplier 63 to generate a musical tone appropriate for signing-off.

The tone signals, processed according to the above described steps involved within the closed-loop circuit 60, are outputted ultimately from the adder 61 to a sound reproduction system (not shown) which reproduces synthesized musical sounds.

A second preferred embodiment is described next. In the first preferred embodiment, with the passage of time $t_1, t_2, \ldots$, the decay coefficients $fg_1, fg_2 \ldots$ are altered in discrete steps. In the second preferred embodiment, the decay coefficients are not held constant during a given time period but are made to decay continuously at some rate during this time period in order to reproduce a musical tone having a complex tone envelope.

What is claimed is:

1. A musical tone synthesizing apparatus comprising:
(a) excitation signal generating means for generating an excitation signal;
(b) closed loop circuit means for receiving said excitation signal from said excitation means, said circuit means including a closed loop circulating path having delay means for delaying a signal circulating in the closed loop, the closed loop circuit means having a delay interval corresponding to the pitch of a musical tone to be generated, wherein a tone signal is obtained from said closed loop circuit means; and
(c) loop gain controlling means for controlling gain of said closed loop circuit means independent of the value of the excitation signal according to a lapse of time, said controlling for modifying the envelope of the signal circulating in the closed loop circuit depending on a period of time elapsed from the initiation of tone generation.

2. A musical tone synthesizing apparatus according to claim 1 further comprising main control means for generating a start signal, wherein said excitation signal generating means generates said excitation signal according to said start signal.

3. A musical tone synthesizing apparatus according to claim 2 wherein said excitation signal is read out from memory according to said start signal.

4. A musical tone synthesizing apparatus according to claim 1 wherein said excitation signal generating means provides initial touch data in accordance with a manner of playing the apparatus, wherein said initial touch data are multiplied by said excitation signal and the result applied to the closed loop.

5. A musical tone synthesizing apparatus according to claim 1 wherein said delay means provides defined delay time values to determine a tone pitch.

6. A musical tone synthesizing apparatus according to claim 1 wherein said closed loop circuit means includes filtering devices having controllably variable filtering coefficients whose numerical values vary according to a lapse of time.

7. A musical tone synthesizing apparatus according to claim 2 wherein said main control means includes means for altering, on a timed periodic basis, said gain in accordance with discrete time values in a memory table.

8. A musical tone synthesizing apparatus according to claim 1 wherein said main control means includes means for altering the gain of said closed feedback signal circulating within said electrical loop in accordance with continuously variable time values in a memory table.

* * * * *